United States Patent [19]

Lokken et al.

[11] Patent Number: 4,798,025

[45] Date of Patent: Jan. 17, 1989

[54] ABRASIVE DISC SUPPORT

[75] Inventors: Roger C. Lokken; John B. Young, both of Woodbury, Minn.

[73] Assignee: Minnesota Mining and Manufacturing Company, St. Paul, Minn.

[21] Appl. No.: 67,047

[22] Filed: Jun. 29, 1987

[51] Int. Cl.[4] ..... B24D 9/08

[52] U.S. Cl. ..... 51/168; 51/358; 51/382; 51/383; 51/384; 51/387

[58] Field of Search ..... 51/382, 383, 384, 387, 51/388, 359, 372, 209 R, 168

[56] References Cited

U.S. PATENT DOCUMENTS 2,641,878 6/1953 Radabaugh ..... 51/388

3,226,888 1/1966 Erenyi ..... 51/362

*Primary Examiner*—Frederick R. Schmidt

*Assistant Examiner*—Maurina Rachuba

*Attorney, Agent, or Firm*—Donald M. Sell; Walter N. Kirn; David W. Anderson

[57] ABSTRACT

A support for an abrasive disc which includes a flat base, an upstanding annular rim and preferably four retainers mounted to the base within the rim and biased toward the rim to grip and retain the disc. The disc may be released by depressing cables connecting opposed diametrical pairs of retainers to withdraw the retainers.

7 Claims, 2 Drawing Sheets

ABRASIVE DISC SUPPORT

BACKGROUND OF THE INVENTION

1. Field of the Invention

The present invention relates to abrasive grinding discs, and particularly, devices adapted for gripping and retaining such discs during grinding or related operations.

2. Description of the Prior Art

A support for an abrasive disc as referred to in the present context is a device which is used to connect a disc having an abrasive surface to a drive motor for rotation. Typical of such supports is the device shown in U.S. Pat. No. 3,226,888 which includes a flat surface for attachment of the abrasive disc and a shaft which may be grasped by a motor driven unit such as an electric drill.

The method of attachment of the abrasive disc to the support in the above patent is magnetic attraction, but many different methods, such as adhesives or clamping bolts, are also known.

Although a disc having an abrasive and specifically designed for grinding is referred to throughout, it should be recognized that any type of surface treatment disc that may be designed to polish, scuff or scrub a surface could be substituted.

SUMMARY OF THE INVENTION

The present invention is a support for an abrasive disc which is particularly useful in the context of a robot grinder wherein a robotic arm or apparatus holds and maneuvers an abrasive disc relative to a workpiece. The present support allows rapid, automated changing of the disc and securely retains the disc during the grinding operation.

In particular, the present invention includes a disc support adapted to grip and support an annular abrasive disc and incorporates a frame having a flat base and an upstanding annular rim, at least one, but preferably four, disc retainers for forcing the disc into and retaining the disc in contact with the annular rim, the retainers consisting of two pairs of retainers diametrically opposed with respect to the frame annular rim, means for biasing each of the retainers toward said annular rim and means for retracting the retainers against the means for biasing and away from the annular rim to permit release of the abrasive disc from the annular rim.

The retainers preferably include projections which overhang the frame annular rim of the frame and have slopes surfaces in contact with the abrasive disc to force the disc into engagement with the support as the retainers are forced toward the rim by springs defining the means for biasing the retainers toward the annular rim.

Also preferably, the retainers are pivotally connected to the base of the frame and are four in number, each spaced 90° around the annular rim of the frame. Diametrically opposed pairs of retainers are connected by cables which define the means for retracting the retainers and operate by causing the paired retainers to be drawn away from the frame annular rim when the cable is depressed toward the frame base.

Alternatively, the retainers may be mounted on rods which allow translational motion rather than the pivoting motion described above.

BRIEF DESCRIPTION OF THE DRAWINGS

The present invention will be more thoroughly described with respect to the accompanying drawings, wherein like numbers to like parts in the several views, and wherein.

DESCRIPTION OF THE PREFERRED EMBODIMENT

Figure 1:
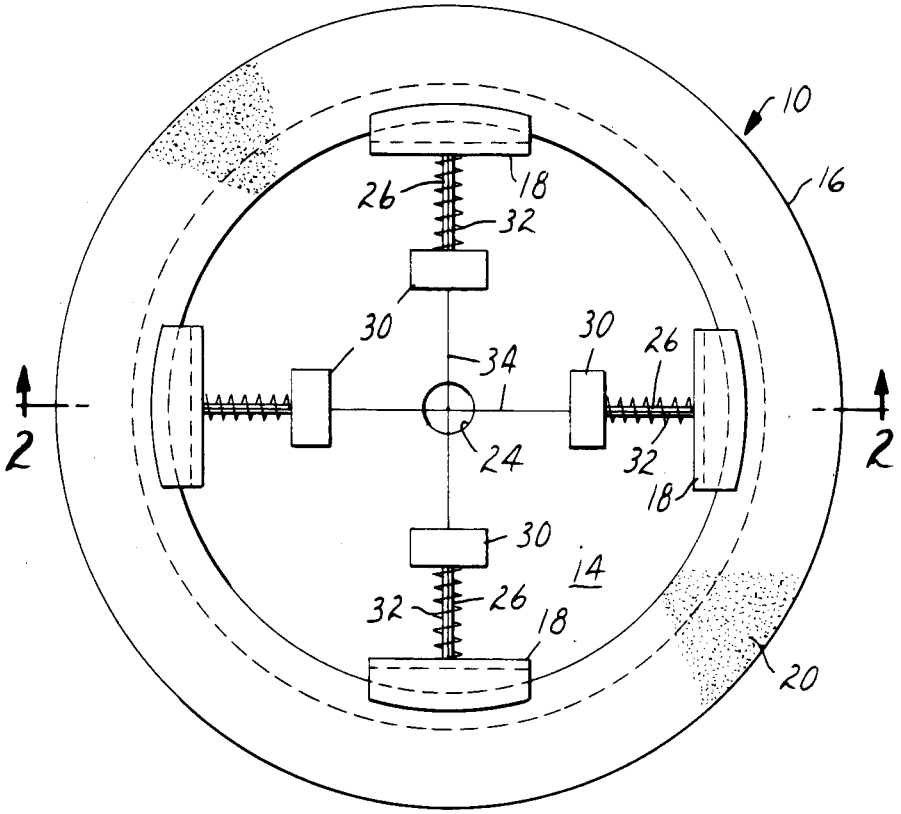
FIG. 1 a plan view of an abrasive disc support of the present invention.

FIG. 1 illustrates an abrasive disc support, generally indicated as 10, which is preferably formed of aluminum and includes a frame 12 having a base 14 and an upstanding annular rim 16. Mounted on the frame 12 are four retainers 18 separated 90° from each other around the rim 16. The retainers 18 each engage an abrasive disc 20 at a sloped surface 22 which forces the disc 20 toward the support 10 as the retainer 18 moves toward the annular rim 16.

The purpose of the support 10 is to retain and support the abrasive disc 20 used to perform a grinding operation. The support 10 is rotated by motor (not shown) which is connected to the base 14 by means of a threaded hole 24 or other suitable means known in the art. It is particularly contemplated that the motor and support 10 be guided by a robotic arm in a production setting, although the invention is entirely applicable to the situation in which the unit is used by a human. For such manual operation the support would be manufactured of a lighter material such as plastic, rather than the preferred aluminum, to reduce weight.

Figure 2:
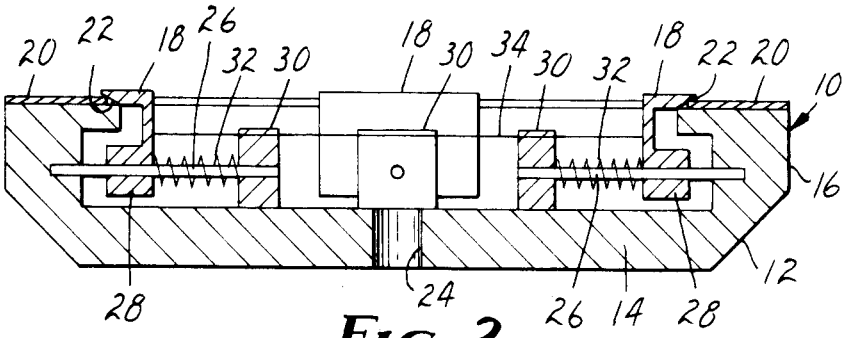
FIG. 2 is a cross-sectional view of the support of the present invention taken generally along the line 2—2 of FIG. 1.
Figure 3:
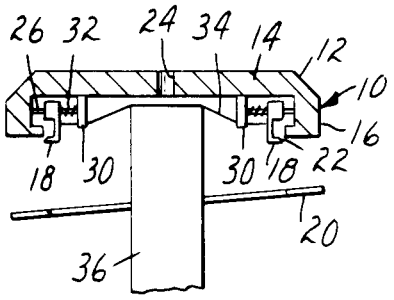
FIG. 3 is an elevational view showing the support of FIG. 1 in operation to eject an abrasive disc, with the support in cross-section.

The retainers 18 of FIGS. 1–3 are each supported by a rod 26 passing through the body 28 of the retainer 18, which rod 26 extends from the annular rim 16 to a block 30 associated with each of the retainers 18 and attached to the base 14 of the frame 12 inwardly of the retainers 18. The retainers 18 are biased toward the annular rim 16 by springs 32 disposed on the rods 26 between the blocks 30 and the retainers 18.

Diametrically opposed pairs of retainers 18 may be retracted against the force of the springs 32 by depressing a cable 34 attached to the retainer 18 pair.

In operation, as shown in FIG. 3, the support is forced against an upright post 36 to depress the cables 34 and retract the retainers 18. Retraction of the retainers allows the abrasive disc 20 to separate from the support. A similar arrangement whereby a disc 20 is arranged to surround a post 36 may be utilized to cause the support 18 to grasp a fresh abrasive disc 20. Such an arrangement is particularly useful when grinding is being done by a robotic arm.

Figure 4:
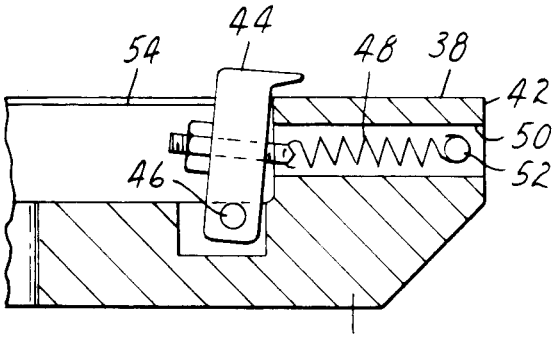
FIG. 4 is a partial, cross-sectional view of an alternate embodiment of the present invention taken from the same perspective as FIG. 2.

An alternate embodiment of the present invention is illustrated in FIG. 4, where there is shown a support 38 which is similar to the support 10 of FIGS. 1–3 in that the support 38 includes a base 40 and an upright annular rim 42. The embodiment of FIG. 4 includes retainers 44 which are identical to those of FIGS. 1–3 except that the retainers 44 pivot with respect to the base 40 rather than translate.

The retainers 44 are attached to the base 40 by means of pivot pins 46 which allow the retainers 44 to rotate toward and away from the annular rim 42. The retainers 44 are biased toward the annular rim 42 by means of springs 48 attached to the retainers 44 and extending into holes 50 located in the annular rim 42. The springs 48 are secured by set screws 52.

Like the embodiment of FIGS. 1–3, the retainers 44 are retracted by cables 54 which connect diametrically opposed pairs of retainers 44. In operation, the support 38 functions identically to support 10.

Thus there has been described an abrasive disc support 10, 38 which offers many advantages, particularly when used in a production setting by an industrial robot. The retainers 18, 44 operate in concert by simply pushing the support 10, 38 against an object so as to contact the cables 34, 54. The retainers 18, 44 tightly force the disc 20 into contact with the support 10, 38 by virtue of spring 32, 48 force, and this force is augmented by centrifugal force as the support 10, 38 spins. The symmetry of the support 10, 38 obviates the need for any particular orientation and many various types of discs may be used interchangeably.

Figure 5:
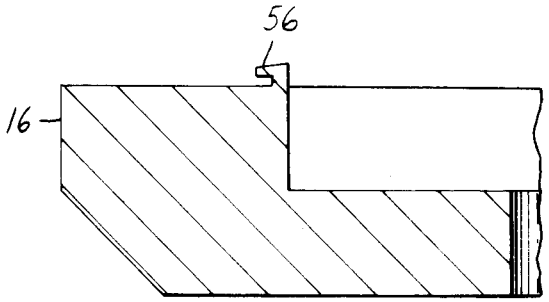
FIG. 5 is a partial, cross-sectional view of a second alternate embodiment of the present invention taken again from the same perspective as FIG. 2.

Although the present invention has been described with respect to only a limited number of embodiments, it is recognized that many modifications will be apparent to those skilled in the art. For example, the support 10, 38 could be supplied with only two diametrically opposed retainers 18, 44 rather than four as shown. It is also possible to attach each retainer 18, 44 individually by cable to the diametrically opposite portion of the annular rim 16, 42 rather than the opposite retainer 18, 44. In this fashion, the number of retainers 18, 44 could be reduced to one, if the opposite edge of the disc 20 were retained by a finger 56 extending from the rim 16, 42 as illustrated in FIG. 5. It is intended that all such modifications falling within the scope of the appended claims be considered part of the present invention.

We claim:

1. A disc support adapted to grip and support an annular abrasive disc comprising:

a frame including a flat base and an upstanding annular rim;

at least one disc retainer for forcing said disc into and retaining said disc in contact with said annular rim;

means for biasing said retainer toward said annular rim; and a cable attached to and extending between said retainer and the diametrically opposite portion of said annular rim and wherein movement of said cable toward said base causes movement of said retainer away from said annular rim.

2. A disc support according to claim 1 wherein said retainer includes a projection overhanging said annular rim when said retainer is not retracted, for capturing said abrasive disc between said annular rim and said retainer projection.

3. A disc support according to claim 2 wherein said retainer projection includes a sloped contact surface in contact with said abrasive disc, said contact surface being oriented to progressively force said disc into contact with said annular rim as said retainer is biased toward said annular rim.

4. A disc support according to claim 1 further including a block associated with said retainer and mounted to said base inwardly of said annular rim and a rod extending from said block to said rim, wherein said retainer is slideably mounted on said rod for movement toward and away form said annular rim.

5. A disc support according to claim 4 wherein said means for biasing said retainer toward said annular rim comprises a spring disposed between said block and said retainer.

6. A disc support adapted to grip and support an annular abrasive disc comprising:

a frame including a flat base and an upstanding annular rim;

two disc retainers diametrically opposed with respect to said annular rim for forcing said disc into and retaining said disc in contact with said annular rim;

means for biasing said retainers toward said annular rim; and a cable attached to and extending between said retainers, wherein movement of said cable toward said base causes movement of said retainers toward each other and away from said annular rim.

7. A disc support adapted to grip and support an annular abrasive disc comprising:

a frame including a flat base and an upstanding annular rim;

four disc retainers spaced at 90 degrees from each other around said annular rim for forcing said disc into sand retaining said disc in contact with said annular rim;

means for biasing said retainers toward said annular rim; and cables connecting diametrically opposed pairs of said retainers which cause movement of said paired retainers away from said annular rim and said disc when said cables are moved toward said base.

* * * * *